US005121992A

United States Patent [19]

List et al.

[11] Patent Number: 5,121,992

[45] Date of Patent: Jun. 16, 1992

[54] MIXING KNEADER

[75] Inventors: Jörg M. List, Pratteln; Walther Schwenk, Kaiseraug; Alfred Kunz, Pratteln, all of Switzerland

[73] Assignee: List AG, Pratteln, Switzerland

[21] Appl. No.: 592,615

[22] Filed: Oct. 4, 1990

[30] Foreign Application Priority Data

Oct. 4, 1989 [CH] Switzerland ..... 03619/89

[51] Int. Cl.[5] ..... B01F 7/00

[52] U.S. Cl. ..... 366/303; 366/307

[58] Field of Search ..... 366/302-304, 366/307, 309, 312, 313, 279, 279, 64-67

[56] References Cited

U.S. PATENT DOCUMENTS

| | | | |
|---|---|---|---|
| 4,032,117 | 6/1977 | Burgess | 366/304 |
| 4,775,243 | 10/1988 | Baumgärtner | 366/313 |
| 4,824,257 | 4/1989 | List et al. | 366/307 |
| 4,826,324 | 5/1989 | Kunz et al. | 366/313 |
| 4,889,431 | 12/1989 | Liechti | 366/309 |
| 4,941,130 | 7/1990 | List et al. | 366/313 |

FOREIGN PATENT DOCUMENTS

| | | | |
|---|---|---|---|
| 0006207 | of 1900 | United Kingdom | 366/66 |

*Primary Examiner*—Harvey C. Hornsby
*Assistant Examiner*—James F. Hook
*Attorney, Agent, or Firm*—Bachman & LaPointe

[57] ABSTRACT

In a mixing kneader for the mechanical and/or thermal treatment of products, there is a shaft (16) arranged in a housing (1), on which shaft disk segments (21) are avoided distributed in the axial direction. In the kneading spaces (24) between the disk segments (21) there are fixed kneading counter-elements (27), which clean the disk segments (21) and shaft (16) and comprise a section (30), running close to the disk segments (21), and an arm (31), running close to the circumferential surface (37) of the shaft (16). In order that the section and the arm can give way to excessive product encrustations on the shaft, a center line (N) of the section (30) close to the disk segments (21) is to run at an inclination, in the direction of rotation (Z) of the shaft (16), corresponding to a secant through the shaft (16). Something similar also applies to the center line (O) of the arm (31) and to a leg (28) adjoining the section (30) at the other end from the arm (31). This has the effect that the formation of product bridges is also provided and the product conveyance and mixing action are improved. In addition, the mechanical stressing of the kneading element and the taking up of torque by the shaft are reduced.

7 Claims, 4 Drawing Sheets

MIXING KNEADER

BACKGROUND OF THE INVENTION

The invention relates to a mixing kneader for the mechanical and/or thermal treatment of products in liquid, pasty and/or pulverulent state.

Such a mixing kneader is known for example from German patent specification No. 2,349,106. There, the fixed kneading counter-element also essentially comprises a hook, which cleans off both the disk segments and the shaft. In this case, in particular the arm cleaning off the shaft is directed against the direction of rotation of the shaft. This has the disadvantage that this part of the hook, the most remote from the fastening point, is exposed to considerable forces, which may emanate for example from a very hard product encrustation on the shaft.

In an extreme case, this arm close to the shaft cuts into the product encrustation and may be torn off as the shaft continues to rotate.

Furthermore, a kneading gap through which the product is pressed forms between the arm close to the shaft and the leg close to the housing, in particular whenever the hook is of a C-shaped design. Since both the arm close to the shaft and leg the close to the housing are static parts, there may easily form between these a product bridge, which may grow until it reaches the opposite kneading element and thus build up a product torus. This has the effect of significantly worsening the kneading action.

Since the kneading counter-elements according to German Patent Specification No. 2,349,106 are exposed to considerable forces, they are preferably cast. This is also so in particular for reasons of their shaping, which is very complicated. Such a cast kneading hook is relatively expensive.

The inventor has set himself the object of developing a mixing kneader of the type mentioned at the beginning in which the kneading counter-elements can be produced inexpensively and are easier to shape. Furthermore, they are to be exposed to lower mechanical forces and, in particular, reduce the torque taken up by the shaft.

SUMMARY OF THE INVENTION

The foregoing object is achieved by a center line of the section close to the disk segments running at an inclination, in the direction of rotation of the shaft, corresponding to a secant through the shaft.

This section consequently no longer meets the shaft radially and is no longer directed against the direction of rotation of the shaft, so that the risk of an excessive stressing of the section or of the arm close to the shaft formed thereto is avoided. For this reason in particular, it is also possible to produce the section and the arm in one piece from a sheet-metal material in band form, with the effect not only of making production easier and cheaper, but also of retaining the desired flexibility, in order that the arm can give way, for example if there are excessive product encrustations on the shaft. This causes it to glide resiliently over these product encrustations and not be destroyed.

In a further exemplary embodiment of the invention, the center line of the arm runs parallel to the circumferential surface of the shaft. In this case it is additionally intended to run in a spiral-like line at an inclination in the direction of rotation of the shaft. This also has the effect that the arm is not opposed by an excessive product encrustation but on the contrary makes it easier for the arm and also the section close to the disk segments to yield flexibly.

A further improvement is achieved by the hook overall having a C-shaped design, the section being adjoined at the other end from the arm by a leg, the center line of which in turn preferably runs in a spiral-like manner at an inclination, in the direction of rotation, at an angle with respect to an imaginary line arranged parallel to the circumferential surface of the housing. This means that the inclination of the leg already has the effect that the thereto-adjoining section close to the disk segments is brought out from the radial plane between housing inside wall and shaft.

However, this also has the advantage that there is produced between the leg and the shaft a kneading area which is formed on the one hand by the static leg and on the other hand by the rotating shaft. The product then does not have to pass through a kneading area between two static parts of the apparatus, so that no stationary product torus can build up here. The shaft forces the product through the kneading area, without the shaft having to take up increased force for this purpose. The area then following the kneading area, between the static leg close to the housing inside wall and the arm close to the shaft, has a larger opening area, so that the product previously deformed in the kneading area passes through this area without difficulties.

Furthermore, it has been found to be favorable for a rest, the axis of which runs approximately radially to the axis of rotation of the shaft, to adjoin the leg, if there is one, or if not to adjoin the section directly. This rest is to serve for holding the complete hook and, together with the leg and a part of the housing inside wall assigned to the leg, forms a kneading gap. Then, part of a kneading bar, which is arranged on the disk segments of the shaft, can go through this kneading gap.

In practice, this kneading counter-element according to the invention has produced a significantly improved mixing action and product conveyance, making its production easier and cheaper. In addition, the torque take-up is significantly reduced.

This applies in particular if the hook of the kneading counter-element is produced in one piece from a metal strip in band form as a sheet-metal hook. It goes without saying that, by appropriate choice of its thickness in relation to its width or respective length, this sheet-metal hook has a sufficient rigidity which nevertheless does not impair the flexibility of the hook. After the bending-off, curving or cranking of the hook it is sufficient if the edge is ground or appropriately bevelled in order to produce a scraping edge, for example for the circumferential surface of the shaft against the arm and the surface of the disk segments against the section.

The connection between leg and rest can also be made easier by fitting onto the end face of the rest a cone which engages in a corresponding opening in the leg. It is then fixed there by welding.

BRIEF DESCRIPTION OF THE DRAWINGS

Further advantages, features and details of the invention emerge from the following description of the preferred exemplary embodiments and with reference to the drawing, in which.

DETAILED DESCRIPTION OF THE INVENTION

Figure 1:
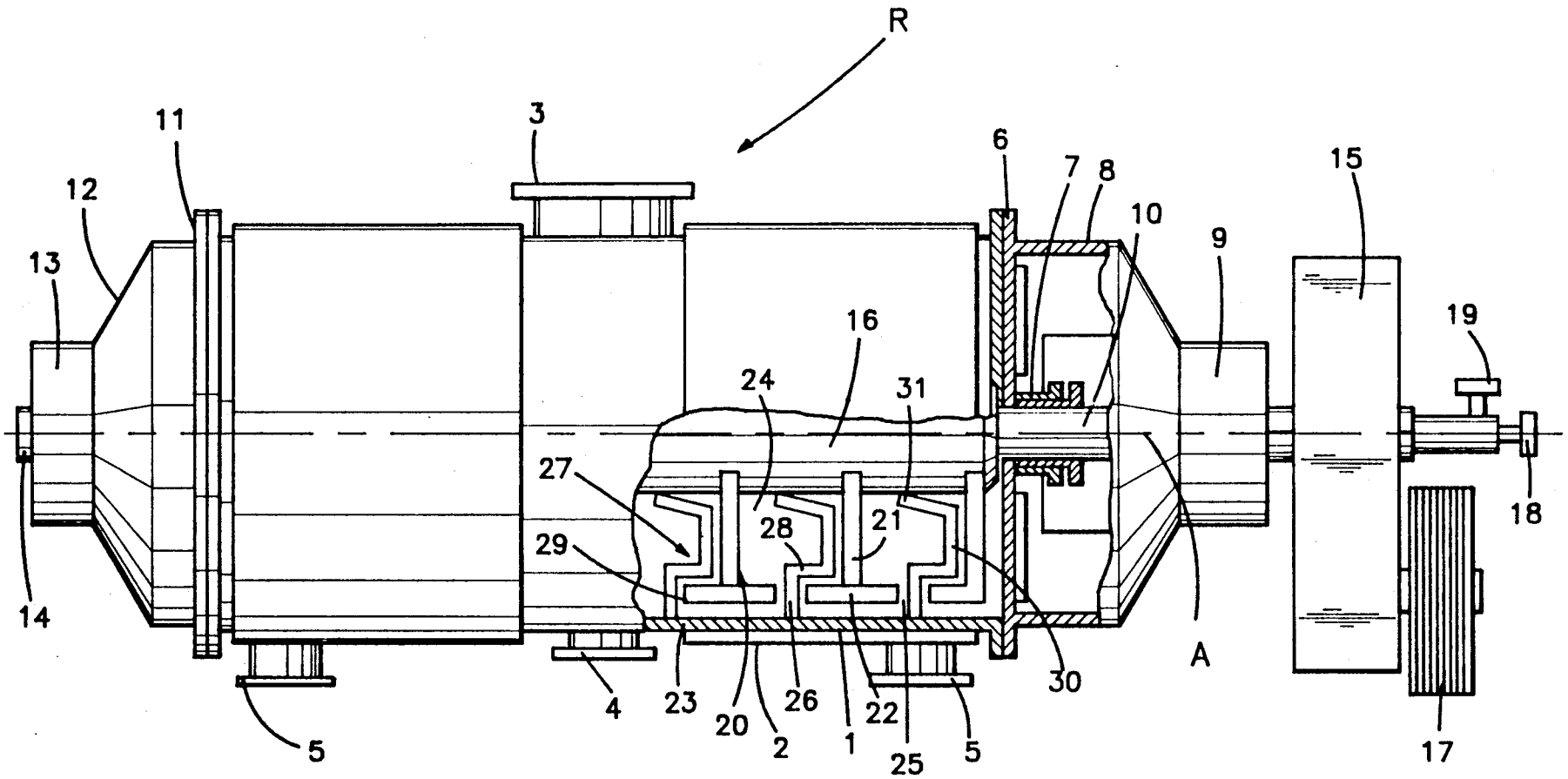
FIG. 1 shows a side view, partially broken away, of a mixing kneader according to the invention.

According to FIG. 1, a mixing kneader R according to the invention has a housing 1. This housing 1 is surrounded by a heating jacket 2 or by heating channels. For filling with a starting product and for extracting vapors, there are at the top of the housing 1 one or more branches 3. An outlet of the product on which treatment has been finished takes place at a lower outlet branch 4. Feet 5 serve to support the mixing kneader R.

An end wall 6 is equipped with a gland 7 and connected to a lantern 8 for supporting a bearing 9 for a stirring shaft journal 10. Opposite the end wall 6, a further end wall 11 closes the housing 1, there too a lantern 12 surrounding a corresponding gland (not shown in any further detail) and a bearing 13 adjoining this lantern 12. The opposite stirring shaft journal 14 also protrudes from this bearing 13.

Furthermore, the stirring shaft journal 10 passes through the bearing 9 and is thereafter connected to a slip-on gear unit 15, by means of which the stirring shaft journals 10 and 14, and consequently a shaft 16, are turned about the axis A. The drive is in this case performed by means of a drive motor (not shown in any further detail), which turns a V-belt pulley 17.

The shaft 16 is normally capable of being heated and cooled, the supply of the corresponding heating or cooling medium taking place through a branch 18 and the return taking place through a further branch 19.

Kneading elements 20, which essentially comprise disk segments 21 and fitted-on kneading bars 22, are seated on the shaft 16. The disk segments 21 turn with the shaft 16, the kneading bars 22 brushing past the inner housing shell 23 at a small distance from it. These kneading bars 22 thereby clean the inner housing shell of any product encrustations there may be.

Neighboring disk segments 21 form between themselves a kneading space 24. Furthermore, neighboring kneading bars 22 leave a void 25 open between themselves, through which a rest 26 of a kneading counter-element 27 can slide through in the position for use. This kneading counter-element 27 is essentially designed as a kneading hook, the rest 26, running radially to the shaft 16, being adjoined by an axially parallel leg 28. This axially parallel leg 28, which however otherwise may run spirally at an inclination, parallel to the housing inside surface, forms together with the respective part of the kneading bar 22 a kneading gap 29, through which the kneading bar 22 has to move. In this case, the product to be processed is also forced between the leg 28 and the inner housing shell 23, is sheared and kneaded.

The axially parallel leg 28 is then in turn adjoined, close to the disk segment 21, by a radial section 30, which extends up to close to the shaft 16. This radial section 30 has the task of freeing the disk segments 21 from product encrustations. Likewise, the product is of course also sheared between the radial section and the disk segment, so that this as well has the effect of improving the kneading action.

Finally, the radial section 30 then also has formed on it an arm 31, which is assigned to the shaft 16 is preferably adapted to the part of the circumferential surface of the shaft 16 and slides closely past this circumferential surface. This arm 31 primarily has the task of cleaning the circumferential surface of the shaft 16.

FIG. 1 shows kneading counter-elements 27, which in each case come close to the disk segments 21 only on one side. Similar kneading counter-elements may be provided oppositely in the housing 1, which is not shown in any further detail however, these kneading counter-elements then brushing off the other surface of the disk segments 21 with a corresponding radial section as they slide past and also scraping off the circumferential surface of the shaft not cleaned by the arm 31.

Figure 2:
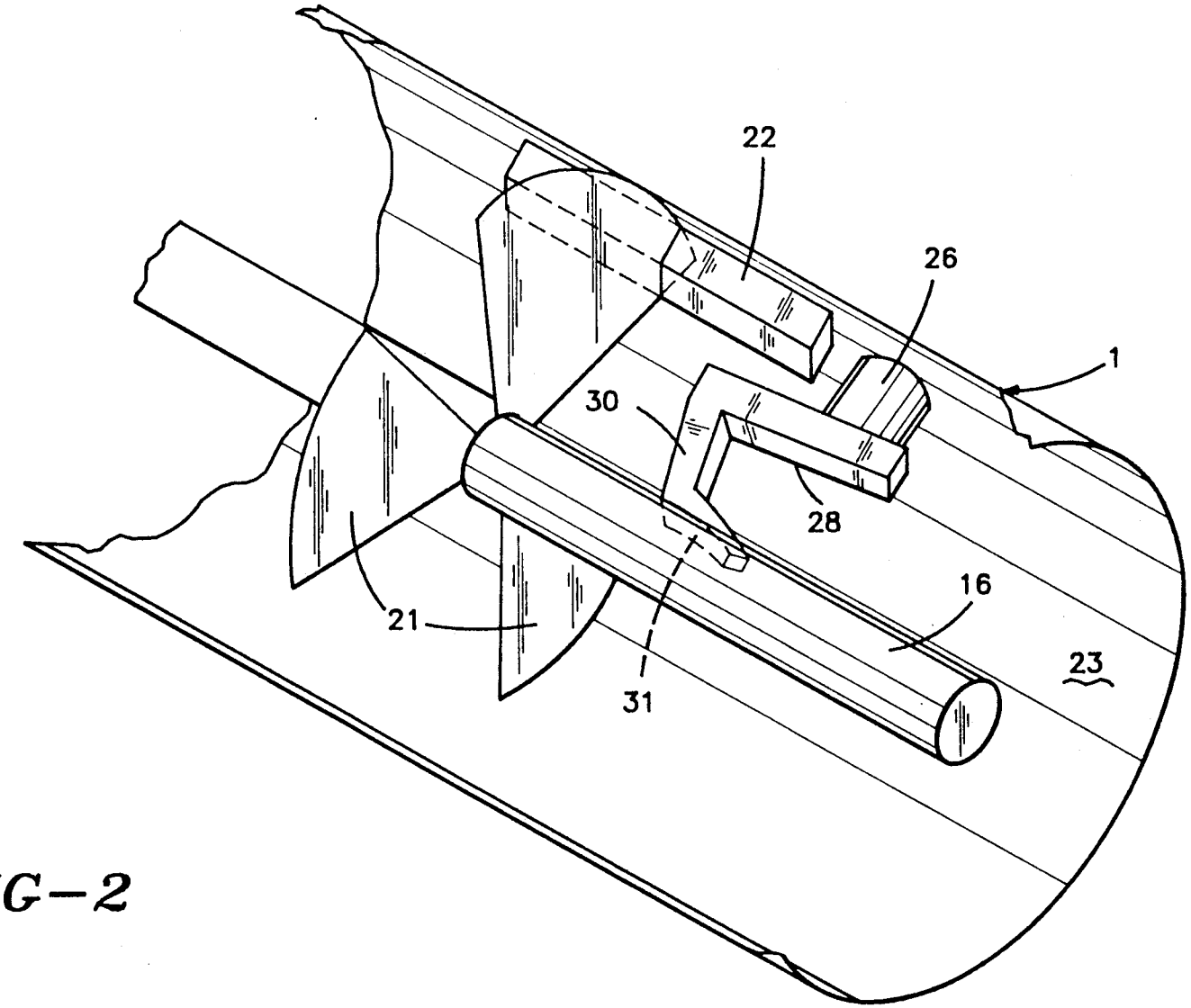
FIG. 2 shows a perspective view, shown diagrammatically, of a part of the opened mixing kneader according to FIG. 1.
Figure 3:
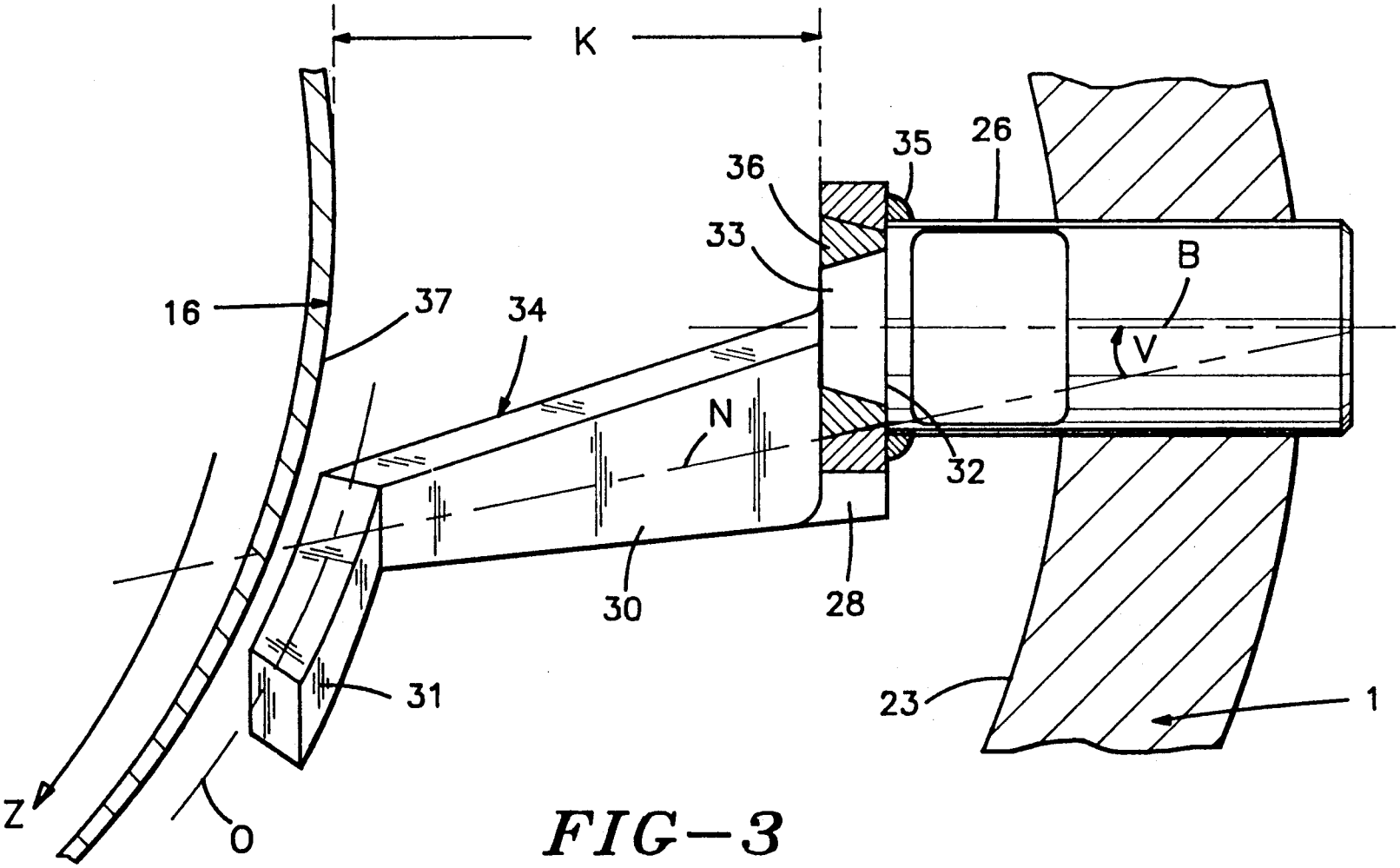
FIG. 3 shows a detail, shown enlarged, of a cross-section through the mixing kneader according to FIG. 1.
Figure 4:
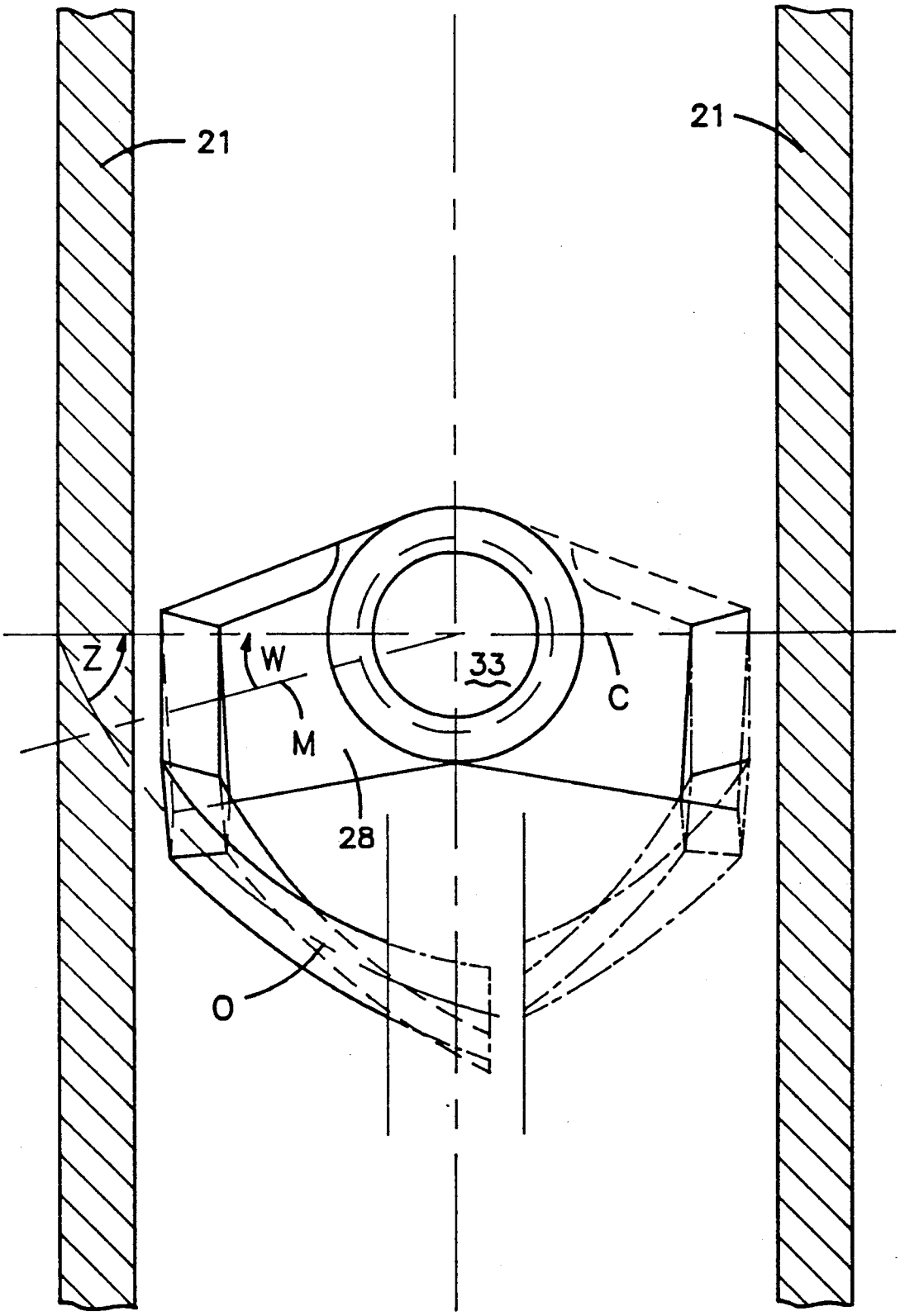
FIG. 4 shows a plan view, shown enlarged, of kneading hooks according to the invention, in their arrangement between two disks.

The arrangement and configuration of the kneading counter-element 27 can be seen better in FIGS. 2, 3 and 4. The rest 26 is seated in the housing 1 in such a way that its axis B runs radially with respect to the axis of rotation A. This rest 26 then has on its end face 32 a cone 33, which is adjoined by a hook 34, produced from a material in band form. This hook 34 comprises the axially parallel leg 28, the radial section 30 and the arm 31. In this arrangement, the cone 33 is fitted in the axially parallel leg 28 and is connected to the rest 26 by means of two welds 35 and 36.

The shaping of the hook 34 is significant. On the one hand, the leg 28, which together with the kneading bar 22 forms the kneading gap 29, runs at an inclination at an angle w with respect to a line C running parallel to the axis of rotation A. This becomes clear in FIG. 4 by the path shown of a center line M of the leg 28 with respect to this line C.

The radial section 30 adjoining the leg 28 likewise has a center line N, which forms an angle v with an imaginary line running parallel to the axis B (see FIG. 3). In this arrangement, this center line N is arranged at an inclination in the direction of rotation Z of the shaft 16.

Finally, the arm 31 has a curved center line O, the curvature of which is adapted approximately to the circumferential surface 37 of the shaft 16. At the same time, this center line O does not run parallel to the axis of rotation A or the line C shown in FIG. 4, but here too at an angle z. Consequently, the arm 31 follows the direction of rotation Z of the shaft 16. The operating principle of this kneading counter-element 27 according to the invention is as follows;

If the shaft 16 turns in the direction of rotation Z the product passes not only into the kneading gap 29 but also into the kneading area K between the static rest 26 or the leg 28 and the moving shaft 16. The rotating shaft 16 thereby forces the product past the static part of the kneading counter-element, as a result of which the leg 28 of the kneading counter-element 27 is only stressed a little. The shaft 16 also is subjected to less stress, with the result that the force taken up by the shaft can be reduced.

After the kneading area K, the product is forced past the radial section 30, after which the area of the kneading space 24 between inner housing shell 23 and arm 31 widens again. This low stressing of the kneading counter-element 27 has the consequence that at least the hook 34 no longer has to be produced by complex production processes, for example casting, but may be formed from a metal sheet. As a result, the production process is made significantly easier and hook production is made cheaper.

At the same time, it is ensured that the arm 31, which follows the direction of rotation Z, can give way to particularly hard crusts on the shaft, so that it is not damaged. This giving-way is possible with a hook formed from sheet metal, whereas until now, with the cast hooks, this arm 31, which also ran at an inclination against the direction of rotation Z, broke off.

FIG. 4 also shows the two kneading counter-elements, which on the one hand clean the left surface and on the other hand clean the right surface of a disk segment 21.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A mixing kneader for the mechanical and/or thermal treatment of products in liquid, pasty and/or pulverulent state, with or without supply or removal of gases and/or vapors, having a housing (1) and a shaft (16) which rotates in the housing (1) about an axis of rotation (A) and on which radial disk segments (21) are provided distributed in the axial direction, there being in the kneading spaces (24) between the disk segments (21) fixed kneading counter-elements (27), which clean the disk segments (21) and shaft (16), and comprise at least a section (30) running close to the disk segments (21) and an arm (31) running close to the circumferential surface (37) of the shaft (16), wherein a center line (N) of the section (30) close to the disk segments (21) runs at an inclination, in the direction of rotation (Z) of the shaft (16), corresponding to a secant through the shaft (16) wherein the arm (31) runs parallel to the circumferential surface (37) of the shaft (16) and is inclined in the direction of rotation (Z) of the shaft (16) away from the section (30).

2. The mixing kneader as claimed in claim 1, wherein a center line (O) of the arm (31) runs parallel to the circumferential surface (37) of the shaft (16).

3. The mixing kneader as claimed in claim 1, wherein the section (30) is adjoined at the other end from the arm (31) by a leg (28), the center line (M) of which runs at an inclination, in the direction of rotation (Z), at an angle (w) with respect to an imaginary line (C) arranged parallel to the axis of rotation (A).

4. The mixing kneader as claimed in claim 1, wherein the section (30) or the leg (28) is adjoined by a rest (26), the axis (B) of which runs radially to the axis of rotation (A).

5. The mixing kneader as claimed in claim 4, wherein leg (28), rest (26) and the part of a housing inside wall (23) assigned to the leg (28) form a kneading gap (29), which interacts with parts of kneading bars (22) on the disk segments (21).

6. The mixing kneader as claimed in claim 1, wherein section (30), arm (31) and possibly leg (28) are produced in one piece as a hook (34) from a metal strip in band form.

7. The mixing kneader as claimed in claim 6, wherein the production of the hook (34) is performed by curving, cranking and/or bending.

* * * * *